US008943674B2

(12) United States Patent
Chen et al.

(10) Patent No.: US 8,943,674 B2
(45) Date of Patent: Feb. 3, 2015

(54) METHOD OF MAKING A PATCH ANTENNA HAVING AN INSULATION MATERIAL

(71) Applicant: Wistron NeWeb Corporation, Hsichih, Taipei Hsien (TW)

(72) Inventors: Shih-Hong Chen, Taipei Hsien (TW); Chieh-Sheng Hsu, Taipei Hsien (TW); Chang-Hsiu Huang, Taipei Hsien (TW); Chi-Chung Chang, Taipei Hsien (TW)

(73) Assignee: Wistron NeWeb Corp. (TW)

( * ) Notice: Subject to any disclaimer, the term of this patent is extended or adjusted under 35 U.S.C. 154(b) by 0 days.

(21) Appl. No.: 13/925,077

(22) Filed: Jun. 24, 2013

(65) Prior Publication Data

US 2013/0285278 A1 Oct. 31, 2013

Related U.S. Application Data

(62) Division of application No. 13/082,977, filed on Apr. 8, 2011, now Pat. No. 8,522,421, which is a division of application No. 12/157,659, filed on Jun. 12, 2008, now abandoned.

(30) Foreign Application Priority Data

Dec. 27, 2007 (TW) ..... 96150529 A

(51) Int. Cl.
*H01P 11/00* (2006.01)
*H01Q 9/04* (2006.01)

(52) U.S. Cl.
CPC ..... *H01Q 9/0414* (2013.01); *H01Q 9/0421* (2013.01)
USPC ..... 29/600; 29/592.1; 343/700 MS

(58) Field of Classification Search
CPC ..... H01Q 9/0421; H01Q 9/0414; H01Q 1/38; H01Q 9/30; H01Q 9/02; H01Q 9/044; H01Q 9/16; H01Q 9/285; B29C 45/14655
USPC ..... 29/600, 601, 592.1, 830, 846–847; 343/700 MS, 786
See application file for complete search history.

(56) References Cited

U.S. PATENT DOCUMENTS

| | | | | |
|---|---|---|---|---|
| 4,040,060 | A | 8/1977 | Kaloi | |
| 4,131,894 | A | 12/1978 | Schiavone | |
| 4,761,654 | A | 8/1988 | Zaghloul | |
| 5,057,848 | A | 10/1991 | Rankin et al. | |
| 5,099,249 | A * | 3/1992 | Seavey | 343/700 MS |
| 5,119,107 | A | 6/1992 | Wildey et al. | |
| 5,220,334 | A | 6/1993 | Raugenet et al. | |
| 5,315,753 | A | 5/1994 | Jensen et al. | |
| 6,806,831 | B2 * | 10/2004 | Johansson et al. | 343/700 MS |
| 7,050,006 | B2 * | 5/2006 | Jan et al. | 343/700 MS |
| 7,053,833 | B2 * | 5/2006 | Hsu et al. | 343/700 MS |
| 7,202,817 | B2 | 4/2007 | Shinkai et al. | |
| 8,522,421 | B2 * | 9/2013 | Chen et al. | 29/600 |
| 2013/0285278 | A1 * | 10/2013 | Chen et al. | 264/152 |

* cited by examiner

*Primary Examiner* — Minh Trinh
(74) *Attorney, Agent, or Firm* — Merchant & Gould P.C.

(57) ABSTRACT

A method of making a patch antenna includes the steps of: stamping a first metal plate to form a first plate body, a first aperture and a first protruding portion to thereby form a radiation metal layer; stamping a second metal plate to form a second plate body, a second aperture and a second protruding portion to thereby form a grounding metal layer; placing the metal layers in a mold to couple together the first and second protruding portions; and introducing an insulation material into the mold to form a dielectric layer between the metal layers.

10 Claims, 10 Drawing Sheets

METHOD OF MAKING A PATCH ANTENNA HAVING AN INSULATION MATERIAL

CROSS-REFERENCE TO RELATED APPLICATION

This application is a Divisional of U.S. Ser. No. 13/082,977, filed 8 Apr. 2011, now U.S. Pat. No. 8,522,421, issued Sep. 3, 2013, which is a Divisional of U.S. Ser. No. 12/157,659 filed 12 Jun. 2008, now abandoned which claims benefit of Serial No. 096150529, filed 27 Dec. 2007 in Taiwan and which applications are incorporated herein by reference. To the extent appropriate, a claim of priority is made to each of the above disclosed applications.

BACKGROUND OF THE INVENTION

1. Field of the Invention

The present invention relates to a patch antenna for receiving satellite signals, more particularly to a patch antenna and a method of making the same that involves relatively simple manufacturing processes.

2. Description of the Related Art

A commercially available patch antenna for receiving satellite signals (frequency of approximately 2.32~2.3325 GHz) includes a dielectric layer formed from a fluropolymer substrate (such as a Teflon substrate), and a radiation layer and a grounding layer made of copper foil and adhered respectively to opposite surfaces of the fluoropolymer substrate. A through hole is formed in a center of the resulting plate structure, and a wall defining the through hole is covered with a copper layer to thereby establish an electrical connection between the radiation layer and the grounding layer.

Referring to FIG. 1, a process for manufacturing a conventional patch antenna utilizing a fluoropolymer substrate includes the following steps. First, in step 901, opposite surfaces of the fluoropolymer substrate are cleaned, and then the surfaces are corroded using a chemical agent to activate the surfaces. Next, in step 902, the two surfaces of the fluoropolymer substrate are covered with hot melt adhesive films, respectively. In step 903, the hot melt adhesive films are covered respectively with copper foils, and the copper foils are pressed and heated such that the adhesive films melt and the copper foils and the fluoropolymer substrate are bonded together to thereby form a tri-layer plate. In step 904, a hole-punching process is performed on the tri-layer plate to thereby form a through hole therein. Since the fluoropolymer substrate includes fibrous material, when forming the through hole, rough edges and unevenness in a wall defining the through hole may result. Therefore, in step 905, the wall defining the through hole is made even through a chemical corrosion process. Subsequently, in step 906, a copper layer is formed on the wall defining the through hole using an electroplating process, such that the copper layer on the wall of the through hole is connected to the two copper foils. Finally, in step 907, an outer shape of a patch antenna is formed by a stamping process to thereby complete manufacture of the patch antenna.

In the above manufacturing process, chemical etching is required since it is difficult to work with the surfaces of the fluoropolymer substrate. This not only complicates manufacture but also results in the generation of chemical liquid waste. In addition, the material costs associated with the fluoropolymer substrate are high, the fluoropolymer substrate is not easily recycled, and a substantial amount of non-recyclable waste material is generated when punching the fluoropolymer substrate.

Therefore, the manufacture of patch antennas using a fluoropolymer substrate not only results in complicated manufacture and high production costs, but also results in the generation of a significant amount of waste material that adversely affects the environment.

SUMMARY OF THE INVENTION

Therefore, an object of this invention is to provide a patch antenna that is low in cost.

According to one aspect, the patch antenna of this invention includes: a dielectric layer made of an insulation material, and having an upper surface, a lower surface, and a through hole; a radiation metal layer disposed on the upper surface of the dielectric layer, and having a first plate body, a first aperture aligned with the through hole, and a first protruding portion extending from the first plate body at a peripheral edge of the first aperture into the through hole; and a grounding metal layer disposed on the lower surface of the dielectric layer, and having a second plate body, a second aperture aligned with the through hole, and a second protruding portion extending from the second plate body at a peripheral edge of the second aperture into the through hole, the first protruding portion and the second protruding portion contacting each other in the through hole to establish an electrical connection between the radiation metal layer and the grounding metal layer.

Another object of this invention is to provide a method of making a patch antenna that involves simple processes, that is low in cost, and that is environmentally friendly.

According to another aspect of this invention, the method of making a patch antenna includes the steps of: stamping a first metal plate to form a first plate body having a predetermined shape, and simultaneously, a first aperture in the first plate body and a first protruding portion that extends from a peripheral edge of the first aperture to thereby form a radiation metal layer; stamping a second metal plate to form a second plate body having a predetermined shape, and simultaneously, a second aperture in the second plate body and a second protruding portion that extends from a peripheral edge of the second aperture to thereby form a grounding metal layer; placing the radiation metal layer and the grounding metal layer in a mold in such a manner that the first protruding portion and the second protruding portion are coupled together; and introducing an insulation material into the mold to form a dielectric layer that is interposed between the radiation metal layer and the grounding metal layer.

According to yet another aspect, the method of making a patch antenna includes the steps of: stamping a metal plate to form a first plate body having a predetermined shape, and simultaneously, a first aperture in the first plate body and a first protruding portion that extends from a peripheral edge of the first aperture to thereby form a radiation metal layer; stamping a second metal plate to form a second plate body having a predetermined shape, and simultaneously, a second aperture in the second plate body and a second protruding portion that extends from a peripheral edge of the second aperture to thereby form a grounding metal layer; preparing a dielectric layer having a through hole; and attaching the radiation metal layer and the grounding metal layer to opposite surfaces of the dielectric layer and in such a manner that the first protruding portion and the second protruding portion are coupled together.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
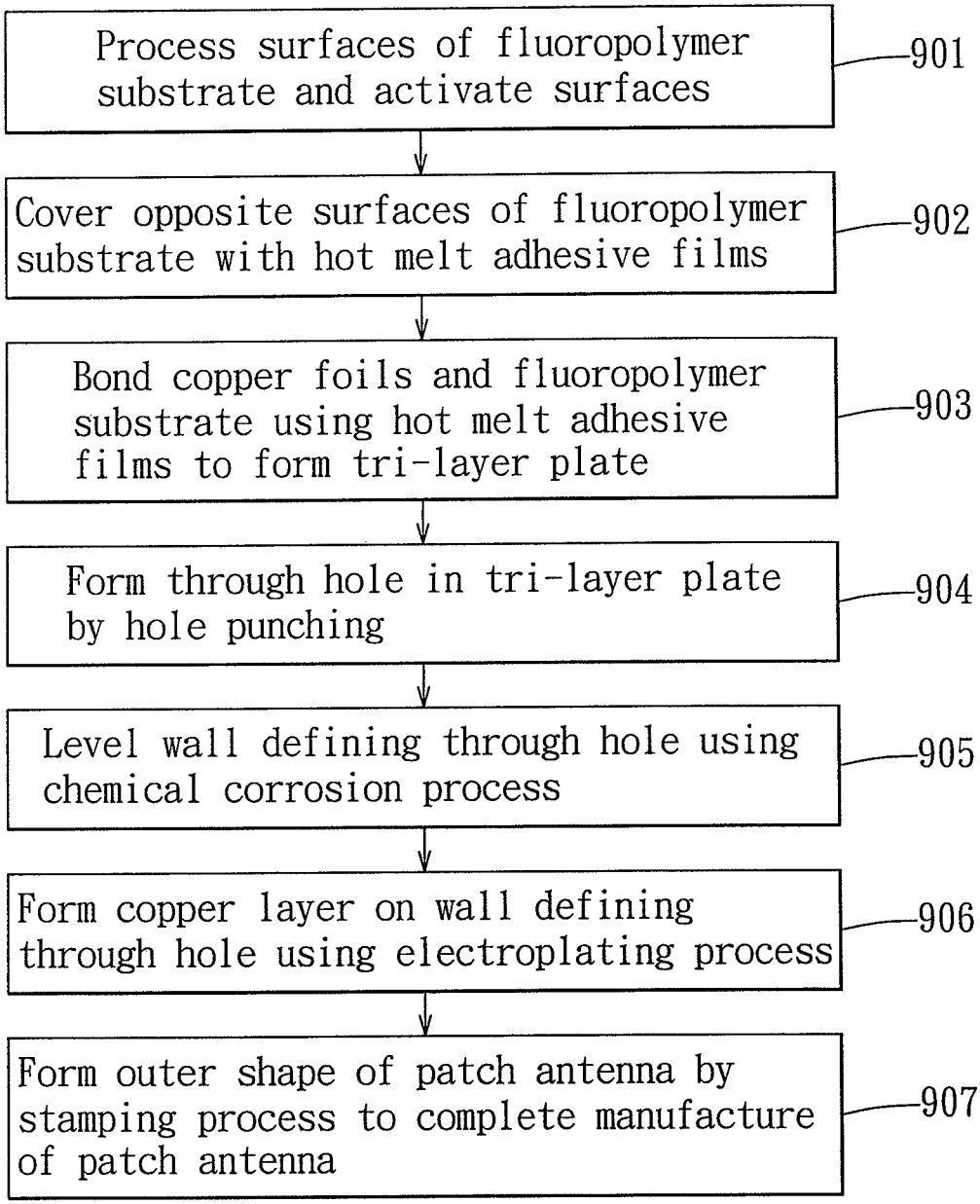
FIG. 1 PRIOR ART
FIG. 1 is a flowchart of a conventional method of making a patch antenna.
Figure 2:
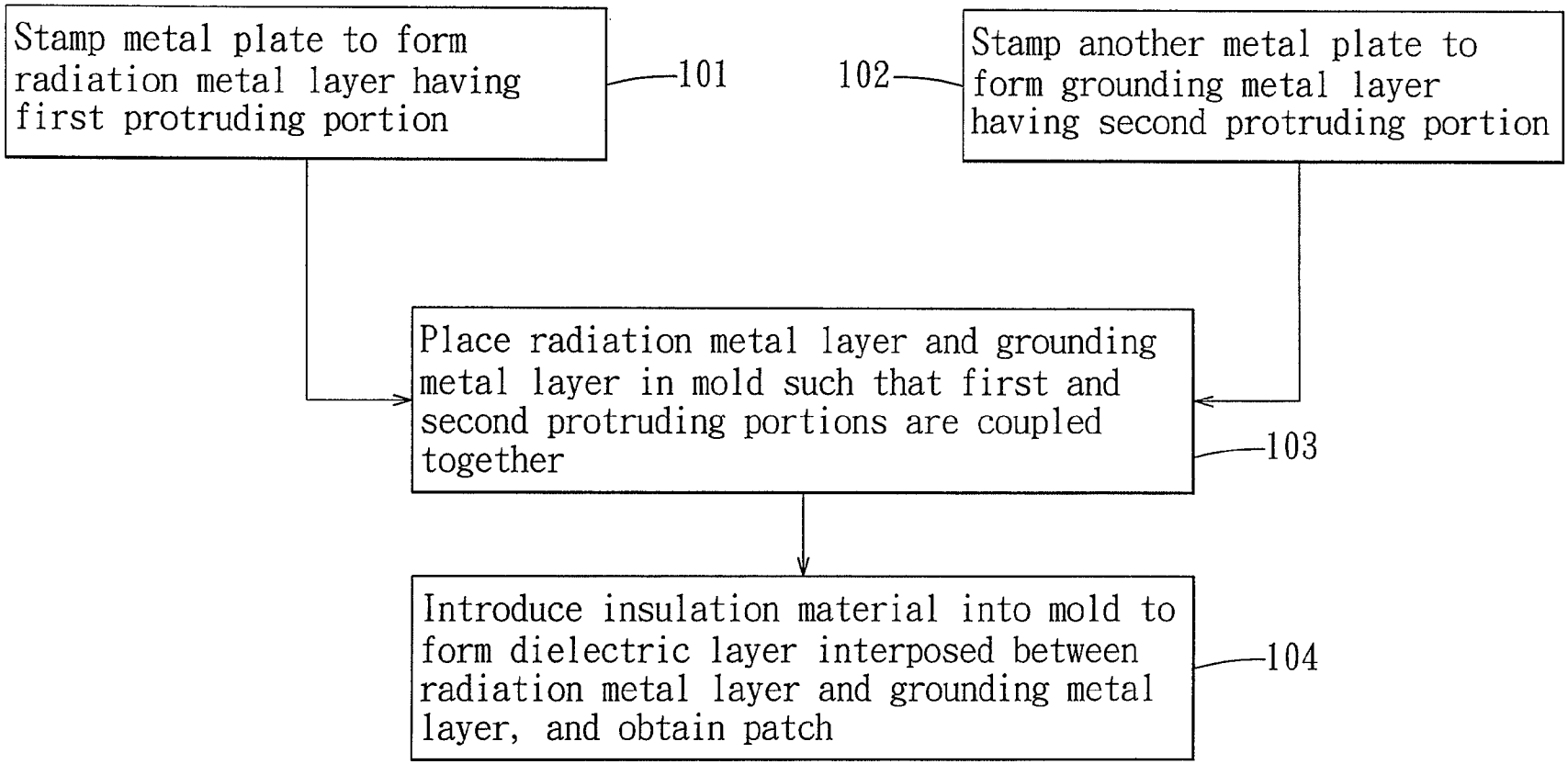
FIG. 2 is a flowchart of a method of making a patch antenna according to a first preferred embodiment of the present invention.

A method of making a patch antenna according to a first preferred embodiment of the present invention will now be described with reference to FIG. 2 and other drawings as specified below.

Figure 3:
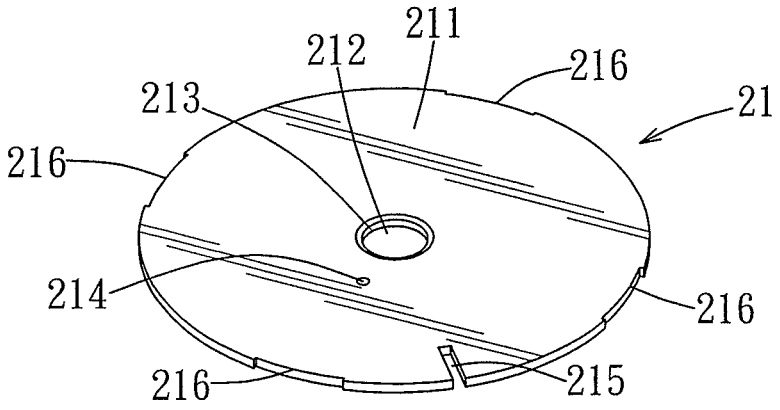
FIG. 3 is a perspective view of a radiation metal layer according to the first preferred embodiment of the present invention.

Referring to FIG. 3, a first metal plate (not shown) is stamped to form a first plate body 211 of a predetermined shape in step 101. In the first preferred embodiment, an outer periphery of the first plate body 211 is substantially circular. Further, a center area of the first plate body 211 is stamped to form a first aperture 212, and a first protruding portion 213 that extends at substantially a right angle from a peripheral edge of the first aperture 212. In addition, a first sub-feed-in hole 214 is formed in the first plate body 211, a guide groove 215 is formed in the first plate body 211 extending from the outer periphery and toward a center of the first plate body 211, and four first indentations 216 are formed in the outer periphery of the first plate body 211 extending inwardly and spaced apart along the outer periphery of the first plate body 211, thereby completing the formation of a radiation metal layer 21.

Figure 4:
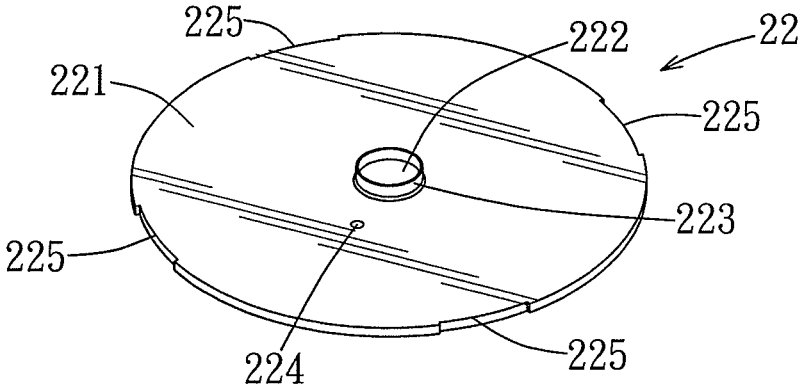
FIG. 4 is a perspective view of a grounding metal layer according to the first preferred embodiment of the present invention.

Referring to FIG. 4, a second metal plate (not shown) is stamped to form a second plate body 221 of a predetermined shape in step 102. In the first preferred embodiment, an outer periphery of the second plate body 221 is substantially circular, and a size of the second plate body 221 corresponds to a size of the first plate body 211. Further, a center area of the second plate body 221 is stamped to form a second aperture 222, and a second protruding portion 223 that extends at substantially a right angle from a peripheral edge of the second aperture 222. In addition, a second sub-feed-in hole 224 is formed in the second plate body 221, and four second indentations 225 are formed in the outer periphery of the second plate body 221 extending inwardly and spaced apart along the outer periphery of the second plate body 221, thereby completing the formation of a grounding metal layer 22.

Figure 5:
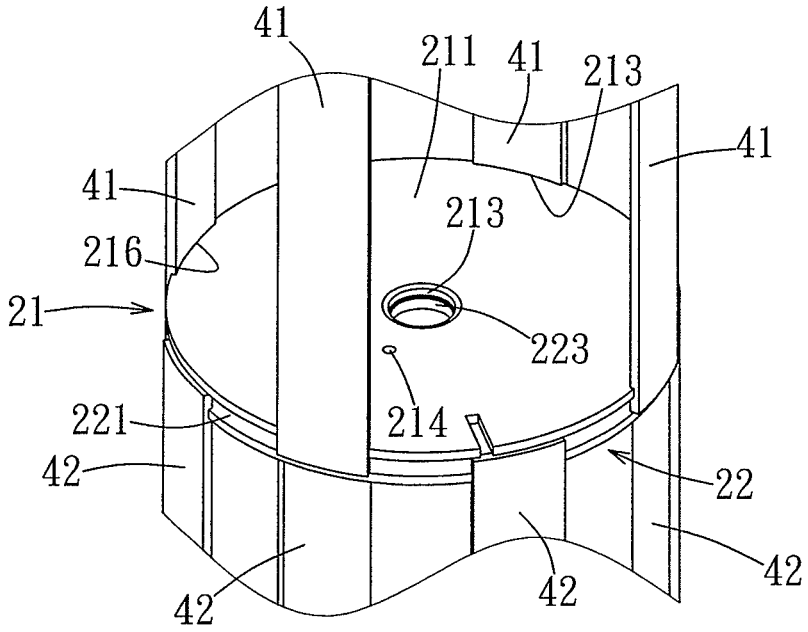
FIG. 5 is a perspective view, illustrating the radiation metal layer and the grounding metal layer of the first preferred embodiment maintained in a parallel state in a mold.

Referring to FIGS. 3, 4, and 5, in step 103, the radiation metal layer 21 and the grounding metal layer 22 are placed in a mold (not shown), such that the first plate body 211 and the second plate body 221 are parallel to each other. Further, four first positioning bars 41 are passed respectively through the first indentations 216 to abut against the second plate body 221, and four second positioning bars 42 are passed respectively through the second indentations 225 to abut against the first plate body 211. Additionally, outer side surfaces of the first plate body 211 and the second plate body 221 abut against the mold. Hence, the first plate body 211 and the second plate body 221 are maintained in a parallel state in the mold to thereby prevent the first plate body 211 and the second plate body 221 from being displaced and deformed when a molten insulation material is introduced into the mold. Moreover, an inner diameter of the first protruding portion 213 is similar to an outer diameter of the second protruding portion 223, such that the first protruding portion 213 and the second protruding portion 223 are coupled fittingly (see FIG. 7). Further, the first sub-feed-in hole 214 and the second sub-feed-in hole 224 are aligned with each other.

Figure 6:
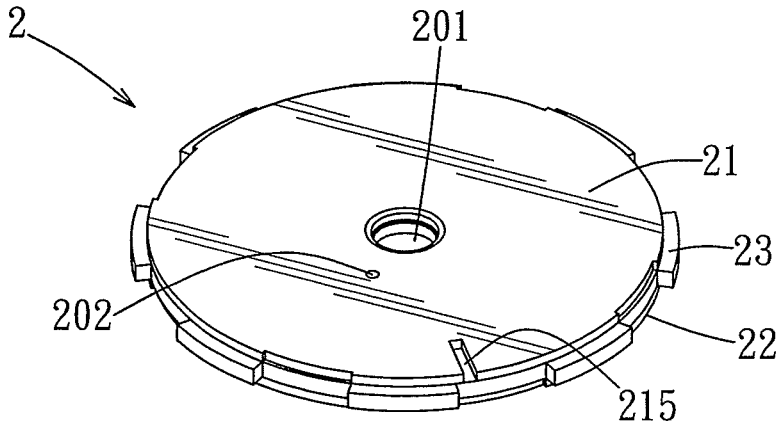
FIG. 6 is a perspective view of a patch antenna according to the first preferred embodiment of the present invention.
Figure 7:
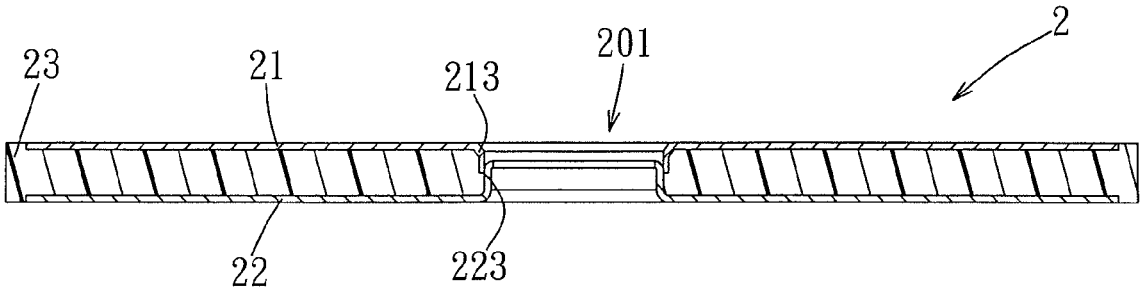
FIG. 7 is a sectional view, illustrating protruding portions of the radiation metal layer and the grounding metal layer coupled together according to the first preferred embodiment of the present invention.

Referring to FIGS. 5, 6, and 7, in step 104, a molten insulation material is introduced into the mold, such that the insulation material fills a space between the radiation metal layer 21 and the grounding metal layer 22. However, an unfilled area 201 is formed by the first protruding portion 213 and the second protruding portion 223, and a bolt (not shown) is passed through the first sub-feed-in hole 214 and the second sub-feed-in hole 224, such that the insulation material is not able to fill these areas, thereby resulting in the formation of through holes after the insulation material hardens. After the insulation material hardens, the elements are removed from the mold. As a result, a dielectric layer 23 is formed interposed between the radiation metal layer 21 and the grounding metal layer 22, and a patch antenna 2 having a through hole 201 and a feed-in hole 202 is obtained. The feed-in hole 202 and the guide groove 215 of the radiation metal layer 21 are used to control the frequency band and field pattern received by the patch antenna 2. Moreover, the end of the first protruding portion 213 and the end of the second protruding portion 223 overlap such that an electrical connection is established between the radiation metal layer 21 and the grounding metal layer 23.

Preferably, a metal material having a low impedance and that is easily soldered is used for making the radiation metal layer 21 and the grounding metal layer 22. In the first preferred embodiment, the metal material is SPTE (electrolytic tin plate) that is manufactured to a thickness of 0.2 mm and that complies with the Japanese JIS G3303 industrial standard.

As for the insulation material for forming the dielectric layer 23, a plastic material is preferably used that may be easily injection molded, and that has a dielectric constant (Df) less than 2.5, a dielectric strength (Dk) less than 0.001, and a heat deflection temperature (HDT) higher than 110° C. In the first preferred embodiment, Noryl RF1132 resin manufactured by the General Electric Company is used for the insulation material.

To prevent the efficiency of the patch antenna 2 from being adversely affected, the first and second indentations 216, 225 are preferably formed extending from the outer peripheries of the first and second plate bodies 211, 221 and toward centers thereof by a distance that does not exceed 0.5 mm.

Figure 8:
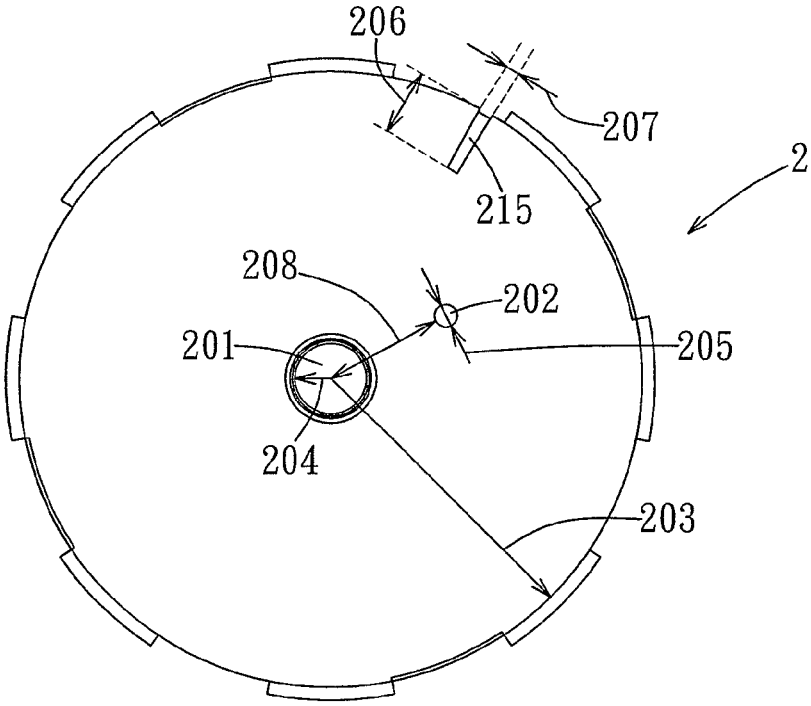
FIG. 8 is a top plan view, illustrating a shape and various dimensions of the patch antenna of the first preferred embodiment of the present invention.
Figure 9:
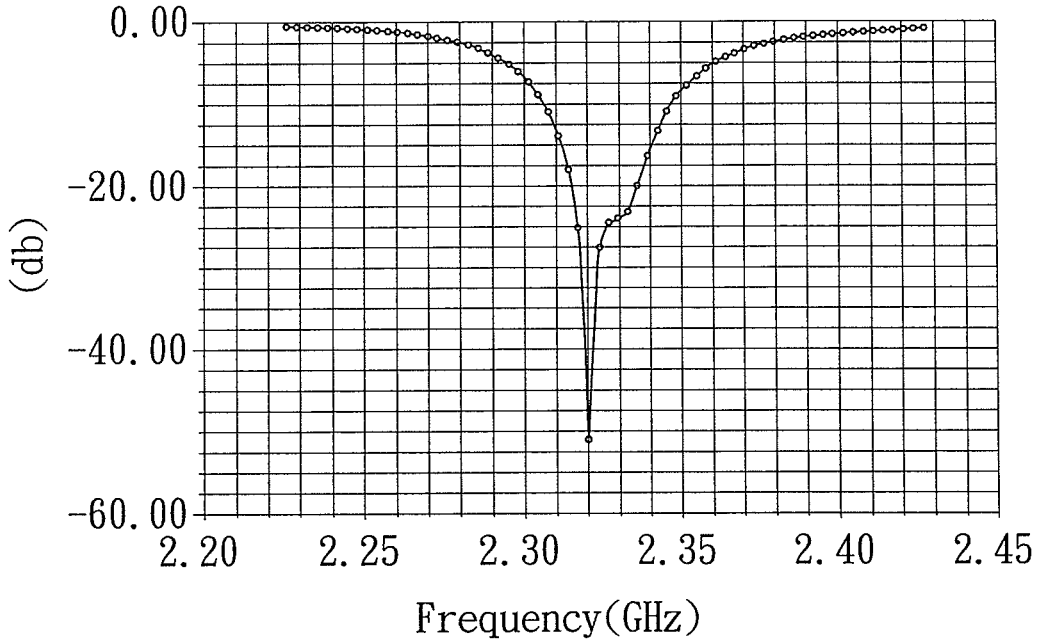
FIG. 9 is an S11 S-parameter plot of the patch antenna of the first preferred embodiment of the present invention.
Figure 10:
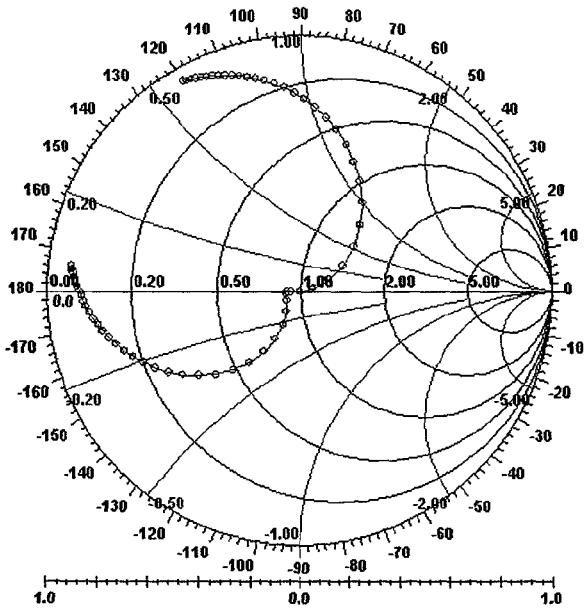
FIG. 10 is a Smith chart of the patch antenna of the first preferred embodiment of the present invention.
Figure 11:
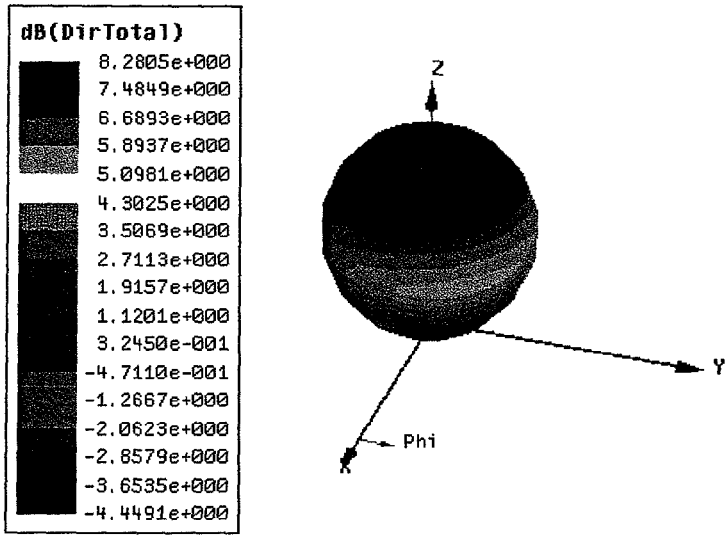
FIG. 11 is a directivity diagram of the patch antenna of the first preferred embodiment.

Referring to FIG. 8, a radius 203 of the patch antenna 2 of the first preferred embodiment is approximately 23 mm, a radius 204 of the through hole 201 is approximately 3.25 mm, a diameter 205 of the feed-in hole 202 is approximately 1 mm, a length 206 of the guide groove 215 is approximately 6 mm, a width 207 of the guide groove 215 is approximately 2 mm, an overall thickness (not indicated) of the patch antenna 2 is approximately 2 mm, and a distance 208 from the feed-in hole 202 to the center of the patch antenna 2 is approximately 7.65 mm. The frequency band and field pattern of the patch antenna 2 obtained through computer simulation are shown in FIGS. 9, 10, and 11.

Figure 12:
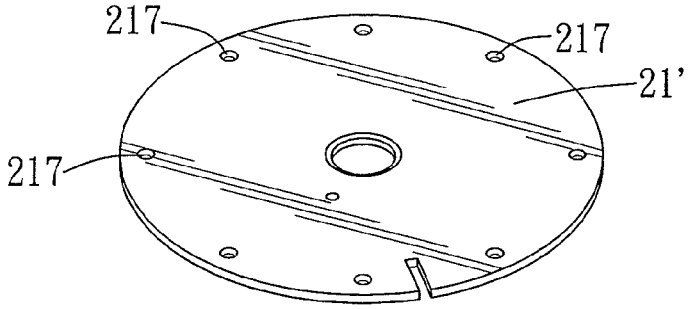
FIG. 12 is a perspective view, illustrating a plurality of prominence portions of the first preferred embodiment.
Figure 13:
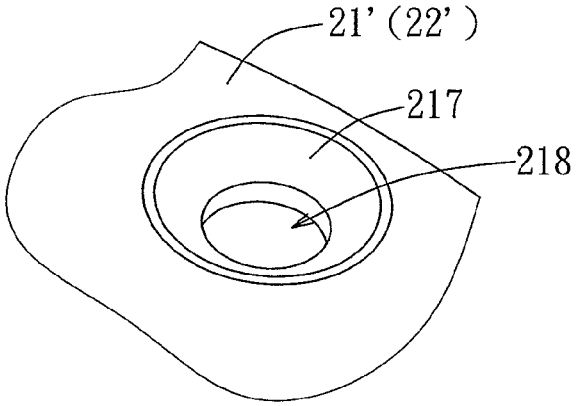
FIG. 13 is a fragmentary enlarged view of FIG. 12, illustrating one of the prominence portions thereof.
Figure 14:
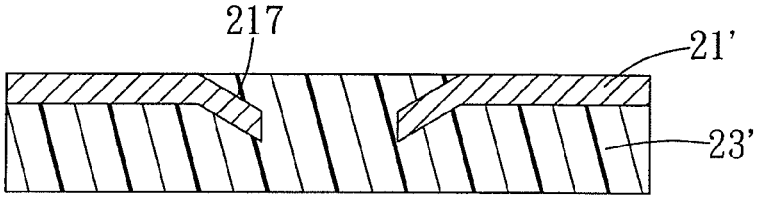
FIG. 14 is a sectional view of FIG. 12, illustrating one of the prominence portions embedded in a dielectric layer.

Referring to FIGS. 12, 13, and 14, when stamp-forming the first plate body 21', a plurality of prominence portions 217 may be formed in the first plate body 21' in proximity to the outer periphery thereof and that extend in the same direction as the first protruding portion 213' thereof. In the first preferred embodiment, the prominence portions 217 are frustoconical in shape and are formed respectively with through holes 218 in centers thereof. When the molten insulation material is introduced into the mold, the molten insulation material fills the through holes 218. After the insulation material hardens, the prominence portions 217 are embedded in the dielectric layer 23' to thereby enhance the connecting force between the first plate body 21' and the dielectric layer 23'. Likewise, when stamp-forming the second plate body 22', a plurality of prominence portions 217 may be formed in the second plate body 22'. A detailed description of the prominence portions 217 of the second plate body 22' is dispensed with for the sake of brevity.

Figure 15:
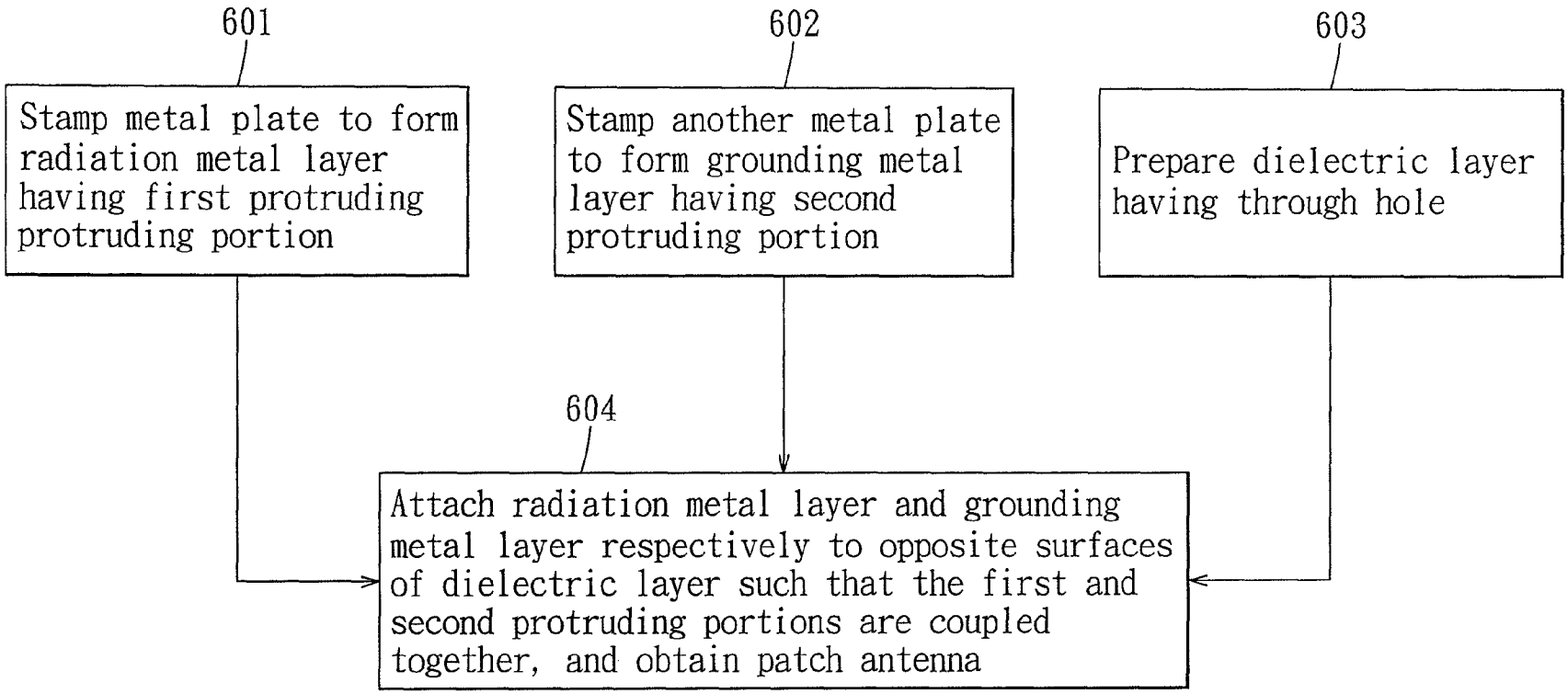
FIG. 15 is a flowchart of a method of making a patch antenna according to a second preferred embodiment of the present invention.

A method of making a patch antenna according to a second preferred embodiment of the present invention will now be described with reference to FIG. 15 and other drawings as specified below. As shown in steps 601~604, the difference between the method of the first preferred embodiment and the method of the second preferred embodiment is that, in the second preferred embodiment, the dielectric layer is manufactured separately from the radiation metal layer and the grounding layer before being bonded with these latter two elements.

Figure 16:
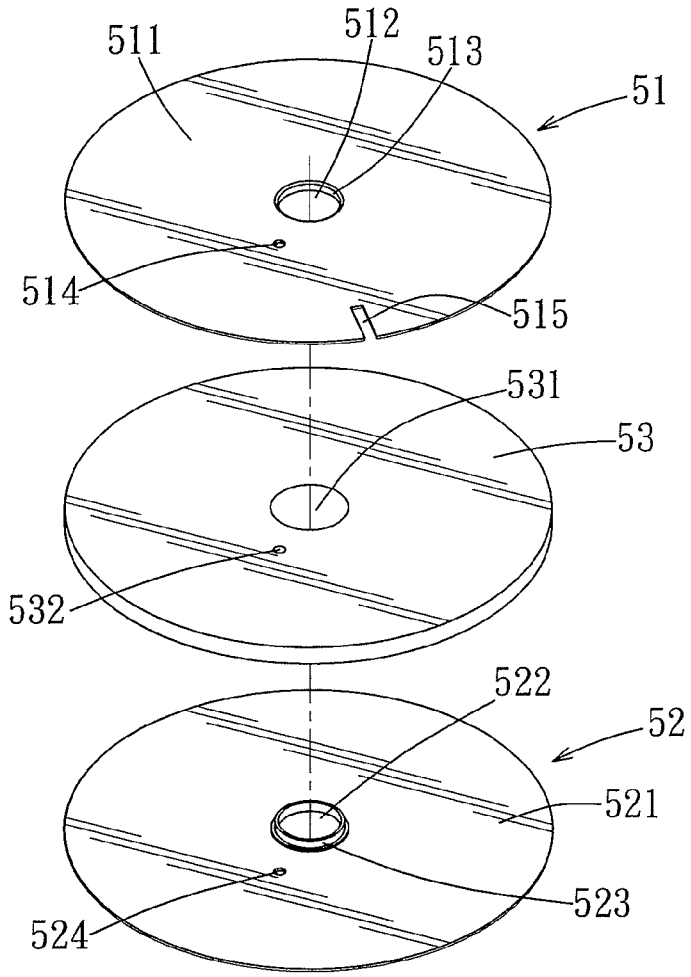
FIG. 16 is an exploded perspective view of a radiation metal layer, a grounding metal layer, and a dielectric layer according to the second preferred embodiment of the present invention, illustrating relative positions among these elements before being bonded together.

Referring to FIG. 16, in step 601, a first metal plate (not shown) is stamped to form a first plate body 511 of a predetermined shape. In the second preferred embodiment, an outer periphery of the first plate body 511 is substantially circular. Further, a center area of the first plate body 511 is stamped to form a first aperture 512, as well as a first protruding portion 513 that extends at substantially a right angle from a peripheral edge of the first aperture 512. In addition, a first sub-feed-in hole 514 is formed in the first plate body 511, and a guide groove 515 is formed in the first plate body 511 extending from the outer periphery and toward a center of the first plate body 511, thereby completing the formation of a radiation metal layer 51.

In step 602, a second metal plate (not shown) is stamped to form a second plate body 521 of a predetermined shape. In the second preferred embodiment, an outer periphery of the second plate body 521 is substantially circular, and a size of the second plate body 521 corresponds to a size of the first plate body 511. Further, a center area of the second plate body 521 is stamped to form a second aperture 522, as well as a second protruding portion 523 that extends at substantially a right angle from a peripheral edge of the second aperture 522. In addition, a second sub-feed-in hole 524 is formed in the second plate body 521, thereby completing the formation of a grounding metal layer 52.

In step 603, a molten insulation material is introduced into a mold (not shown), such that after the insulation material hardens, a dielectric layer 53 of a predetermined shape and that has a through hole 531 in a center area thereof and a feed-in hole 532 is formed.

Figure 17:
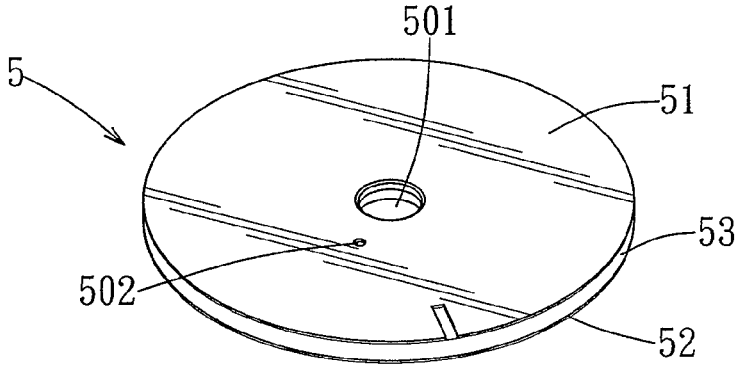
FIG. 17 is a perspective view of a patch antenna according to the second preferred embodiment of the present invention.

Referring to FIGS. 16 and 17, in step 604, opposite surfaces of the dielectric layer 53 are applied with an adhesive, which may be performed by coating the surfaces of the dielectric layer 53 with an adhesive or by applying adhesive droplets to the surfaces of the dielectric layer 53. It is preferable that the adhesive is able to maintain its dielectric properties and does not deteriorate after being subjected to high temperatures (e.g., 300° C. or higher). Next, the radiation metal layer 51 and the dielectric layer 53 are placed opposing each other in such a manner that the first aperture 512 and the through hole 531 are aligned, as are the first sub-feed-in hole 514 and the feed-in hole 532. Subsequently, the first plate body 511 is attached to the upper surface of the dielectric layer 53 such that the first protruding portion 513 is disposed in the through hole 531. In addition, the grounding metal layer 52 and the dielectric layer 53 are placed opposing each other in such a manner that the second aperture 522 and the through hole 531 are aligned, as are the second sub-feed-in hole 524 and the feed-in hole 532. Subsequently, the second plate body 521 is attached to the lower surface of the dielectric layer 53 such that the second protruding portion 523 is disposed in the through hole 531. An inner diameter of the first protruding portion 513 is similar to an outer diameter of the second protruding portion 523 such that the first and second protruding portions 513, 523 may be coupled fittingly together. Moreover, the end of the first protruding portion 513 and the end of the second protruding portion 523 overlap such that an electrical connection is established between the radiation metal layer 51 and the grounding metal layer 53. After the radiation metal layer 51 and the grounding metal layer 53 are attached to the dielectric layer 53, a patch antenna 5 having a through hole 501 and a feed-in hole 502 is obtained.

From the aforementioned, in the method of making a patch antenna of the present invention, an insulation material that is injection molded is used and made to correspond to the structures of the radiation metal layer 21, 51 and the grounding metal layer 22, 52 to thereby simplify manufacture. Compared to the conventional process using a fluoropolymer substrate, the present invention significantly simplifies manufacture of the patch antenna 2, 5, reduces manufacturing costs, and is environmentally friendly. Hence, the objects of the present invention are realized.

While the present invention has been described in connection with what are considered the most practical and preferred embodiments, it is understood that this invention is not limited to the disclosed embodiments but is intended to cover various arrangements included within the spirit and scope of the broadest interpretation so as to encompass all such modifications and equivalent arrangements.

What is claimed is:

1. A method of making a patch antenna, comprising the steps of:

stamping a first metal plate to form a first plate body having a predetermined shape, and simultaneously, a first aperture in the first plate body and a first protruding portion that extends from a peripheral edge of the first aperture to thereby form a radiation metal layer;

stamping a second metal plate to form a second plate body having a predetermined shape, and simultaneously, a second aperture in the second plate body and a second protruding portion that extends from a peripheral edge of the second aperture to thereby form a grounding metal layer;

placing the radiation metal layer and the grounding metal layer in a mold to couple together the first protruding portion and the second protruding portion; and introducing an insulation material into the mold to form a dielectric layer that is interposed between the radiation metal layer and the grounding metal layer.

2. The method of claim 1, wherein, the first plate body is simultaneously formed to have a plurality of first indentations after stamping the first metal plate, in which the plurality of first indentations are formed extending inwardly from an outer periphery of the first plate body and spaced apart along the outer periphery of the first plate body; the second plate body is simultaneously formed to have a plurality of second indentations after stamping the second metal plate, in which the plurality of second indentations are formed extending inwardly from an outer periphery of the second plate body and spaced apart along the outer periphery of the second plate body.

3. The method of claim 2, wherein, when the radiation metal layer and the grounding metal layer are placed in the mold, a plurality of first positioning bars are passed respectively through the first indentations to abut against the second plate body, and a plurality of second positioning bars are passed respectively through the second indentations to abut against the first plate body, the first and second plate bodies are maintained in a state parallel to each other.

4. The method of claim 3, wherein each of the first and second indentations is respectively formed extending inwardly from the outer periphery of a respective one of the first and second plate bodies by a distance that does not exceed 0.5 mm.

5. The method of claim 1, wherein the radiation metal layer is further formed with a plurality of prominence portions extending in the same direction as the first protruding portion.

6. The method of claim 5, wherein the grounding metal layer is further formed with a plurality of prominence portions extending in the same direction as the second protruding portion.

7. The method of claim 6, wherein, when the insulation material is introduced into the mold, the prominence portions are covered by the insulation material so as to be embedded in the dielectric layer.

8. The method of claim 1, wherein, when the insulation material is introduced into the mold, an unfilled area is formed by the first protruding portion and the second protruding portion.

9. The method of claim 1, wherein a first sub-feed-in hole is simultaneously formed when the first plate body is formed; a second sub-feed-in hole is simultaneously formed when the second plate body is formed; the first and second sub-feed-in holes are spatially communicated when a feed-in hole is formed after the dielectric layer is molded.

10. The method of claim 1, wherein when the first plate body is formed, a guide groove is simultaneously formed that extends from an outer periphery of the first plate body toward a center of the first plate body.

* * * * *